US005145479A

United States Patent [19]

Olschansky et al.

[11] Patent Number: 5,145,479

[45] Date of Patent: Sep. 8, 1992

[54] TOTAL BODY EXERCISING APPARATUS

[76] Inventors: Brad Olschansky, 1900 Rambling Ridge La., #202, Baltimore, Md. 21209; Scott Olschansky, 8415 Bellona La; #404, Towson, Md. 21204; Raymond H. Lee, Jr., 11737 Greenspring Ave., Lutherville, Md. 21093

[21] Appl. No.: 679,958

[22] Filed: Apr. 3, 1991

[51] Int. Cl.[5] ..... A63B 21/00

[52] U.S. Cl. ..... 482/62; 482/64

[58] Field of Search ..... 272/73, 131, 132, 93; 128/25 R; 482/62, 57, 63, 64, 114

[56] References Cited

U.S. PATENT DOCUMENTS

| | | | |
|---|---|---|---|
| 3,017,180 | 1/1962 | Aronsohn | 272/73 |
| 4,932,650 | 6/1990 | Bingham et al. | 272/73 |
| 5,016,870 | 5/1991 | Bulloch et al. | 272/73 |

*Primary Examiner*—Stephen R. Crow

*Attorney, Agent, or Firm*—Morton J. Rosenberg; David I. Klein

[57] ABSTRACT

A total body exercising apparatus (100) for exercising the upper and lower body portions of a user (10) with separate and independent resistive loading forces, against which the respective body portion is exercised. The separate and independent resistive loading force assemblies (160,210) are integrated into a single frame structure (102) to permit the simultaneous operation of both the upper and lower body exercising mechanisms, while permitting the resistance loading forces to be independently adjusted. The upper body exercise assembly (170) includes an adjustable upper body crank assembly (171) wherein adjustable crank arm members (172) are rotatively coupled to a pair of respective frame arm members (118,119). Frame arm members (118,119) are angularly adjustable, in the plane of rotation of the crank assembly (171), allowing the total body exercising apparatus (100) to be adaptable to a wide range of users with varying physical characteristics.

18 Claims, 4 Drawing Sheets

TOTAL BODY EXERCISING APPARATUS

BACKGROUND OF THE INVENTION

1. Field of the Invention

This invention is directed to a total body exercising apparatus. Particularly, this invention is directed to an exercising apparatus which allows the user to exercise, either in combination or separately, his upper body, and lower body. Still further, this invention is directed to a total body exercise apparatus wherein the resistive force against which the user exercises his lower body, is separate and independent from the resistive force against which he exercises his upper body. Additionally, this system is directed to a total body exercising apparatus which includes a pair of resistive force mechanisms, each having a rotatable member driven by cyclic motions of the user. The rotatable member of the respective resistance mechanisms are driven in a single predetermined direction, irrespective of the direction in which the user rotates respective crank assemblies. More in particular, this invention pertains to a total body exercising system where the upper body crank assembly is adjustable in reversible angular position, with respect to the plane of rotation of the crank assembly, and with respect to the crank arm length of the crank assembly. Further, the angular position of the upper body crank assembly is pivoted about a location in the neighborhood of a plane passing through the center of gravity of the user.

2. Prior Art

Exercise systems utilizing rotary crank assemblies are well known in the art. The best prior art known to the Applicants includes U.S. Pat. Nos.: 4,582,318; 4,402,502; 3,966,201; 3,759,512; 3,570,477; 3,216,722; 3,213,852; 3,057,201; 3,017,180; 1,909,002; 1,820,372; and, 797,814.

In some prior art systems, such as that disclosed in U.S. Pat. No. 4,582,318, only singular body portions can be exercised. While many prior art systems, in the form of stationary bicycles, are utilized for exercising the lower body of a user, other prior art systems, such as disclosed in the aforementioned U.S. Patent, are directed to exercising just the upper body of a user. Thus, if a user wishes to exercise both upper and lower body portions, he must do so separately, and on separate exercising apparatus. However, there is disclosed a resistance assembly wherein a rotatable member is rotated in a singular predetermined direction, irrespective of the direction in which the rotary crank assembly is operated.

In other prior art systems, such as disclosed in U.S. Pat. Nos. 1,820,372; 1,909,002; 3,017,180; 3,213,852; 3,216,722; 3,570,477; and, 4,402,502, there is disclosed systems which incorporate both upper and lower body exercising crank assemblies. In these systems, some of which are motor assisted, both upper body and lower body crank assemblies are mechanically coupled together for simultaneous operation. These systems incorporate a single resistive force assembly against which both the upper and lower body portions of the user must exercise. Further, none of these prior art systems provide the unique adjustability of the instant invention.

SUMMARY OF THE INVENTION

A total body exercising apparatus is provided. The total body exercising apparatus includes a frame and both a lower body exercising assembly and an upper body exercising assembly, coupled to the frame. The lower body exercising assembly includes a first rotary crank assembly for rotation in either of two opposite directions, and a first resistance assembly coupled to the first rotary crank assembly for providing a selectively adjustable force, resistive to rotation of the first rotary crank assembly. The upper body exercising assembly includes a second rotary crank assembly for rotation in either of two opposite directions, and a second resistance assembly coupled to the second rotary crank assembly for providing a selectively adjustable force, resistive to rotation of the second rotary crank assembly.

DESCRIPTION OF THE PREFERRED EMBODIMENTS

Figure 1:
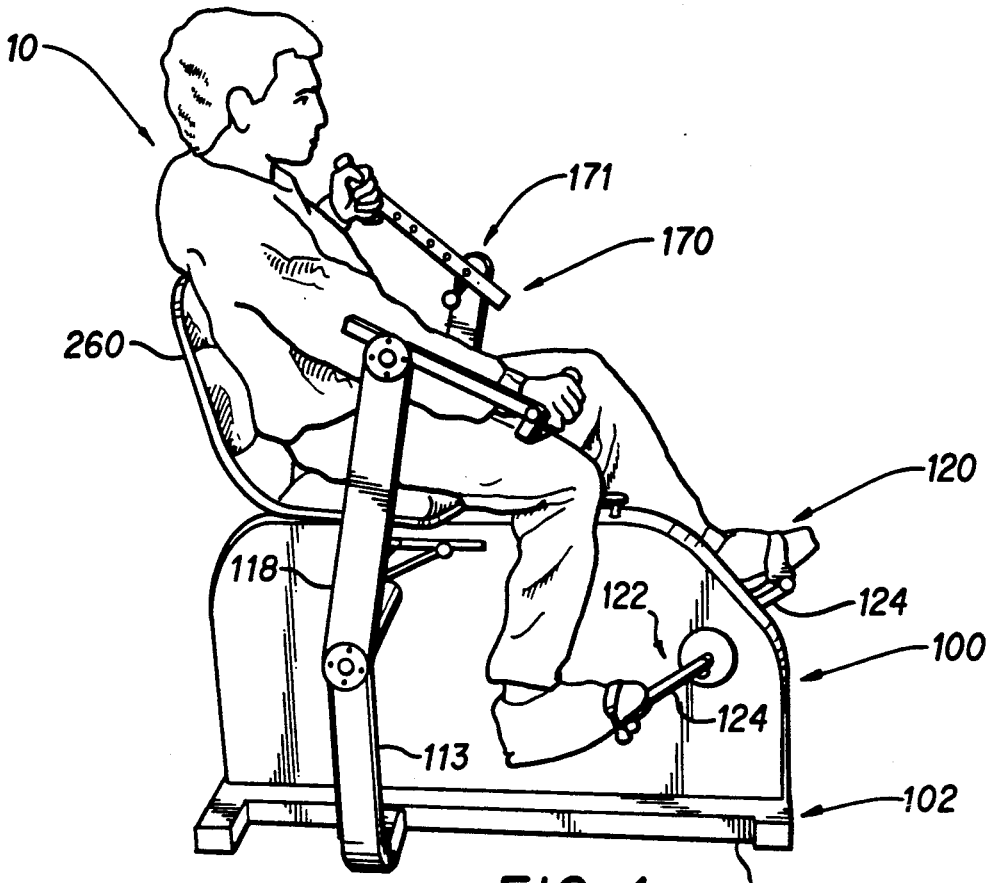
FIG. 1 is a side perspective view of the exercise apparatus in use.

Referring to the Figures, there is shown total body exercising apparatus 100 for providing a separate and independent resistive loading force to the upper and lower body portions of a user 10. In overall concept, the separate and independent resistive loading force assemblies 160, 210 are integrated into a single frame structure 102 to permit the simultaneous operation of both the upper and lower body exercising mechanisms, while permitting the resistance loading forces to be independently adjusted. The novel structure provided by the exercise apparatus 100 permits the user 10 to exercise either his upper body, his lower body, or both upper and lower body together, but independently loaded.

Further, total body exercising apparatus 100 is directed in general concept to an exercising mechanism which provides for adjustability in the apparatus to accommodate a wide range of users' physical characteristics and optimize a particular user's motions. Still further, the exercise apparatus 100 provides a lower body exercise assembly 120 and an independent upper body exercise assembly 170, each of which are rotatively driven by respective portions of the user's body. Additionally, the resistance assemblies 160, 210 include respective rotatable members 162, 212 which are driven in a single predetermined direction, irrespective of the direction of the user applied rotative driving motion, thereby allowing the user to make rapid changes in direction of the rotative driving motion.

Figure 2:
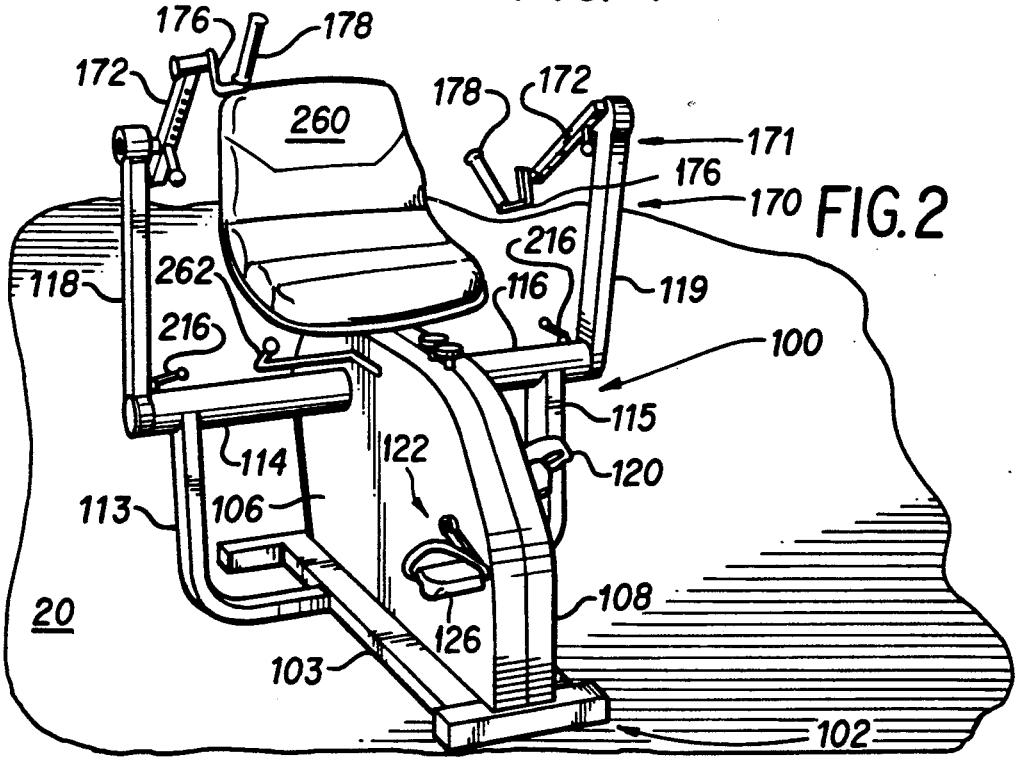
FIG. 2 is a perspective view of the exercise apparatus.
Figure 3:
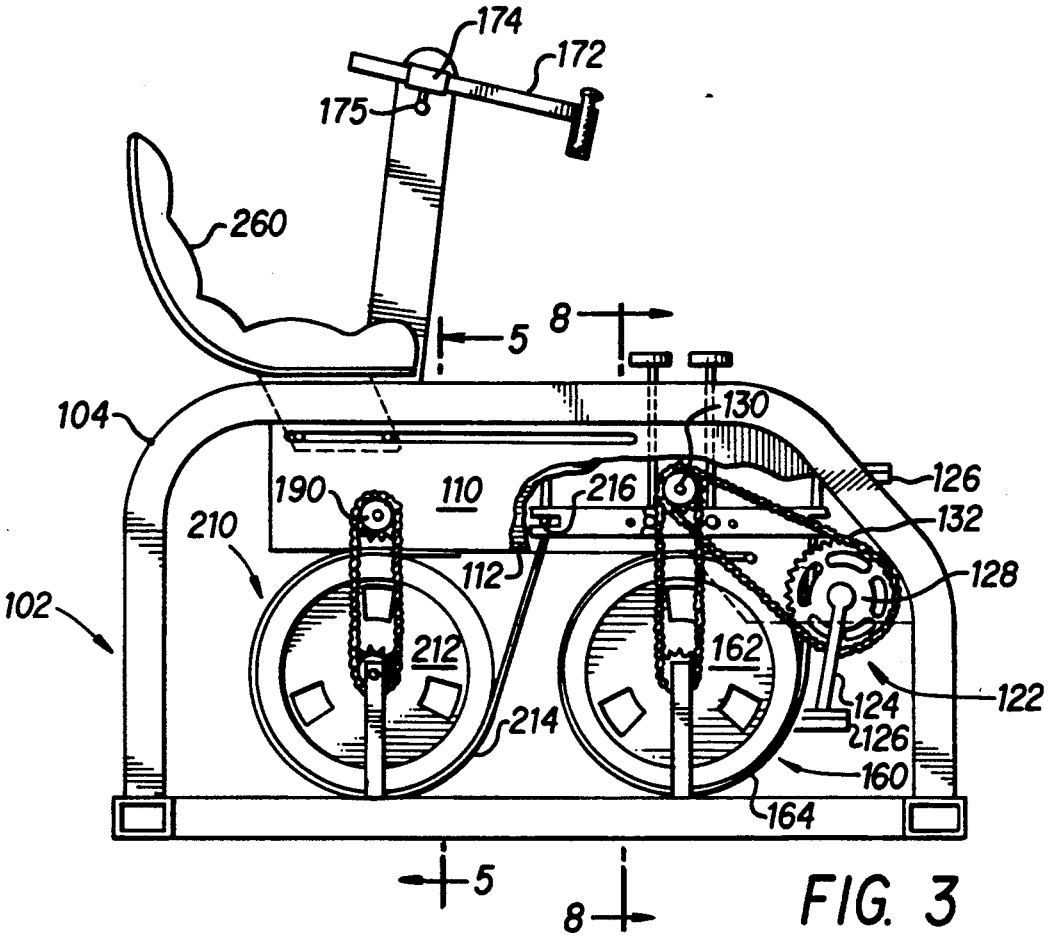
FIG. 3 is a side view, partial in cutaway, of the apparatus.

Referring to FIGS. 1, 2 and 3, total body exercising apparatus 100 is shown as comprising a lower body exercising assembly 120 and an upper body exercising assembly 170 supported by a singular frame assembly 102. The user 10 is provided with an adjustable seat assembly 260 from which the user can participate in the desired exercise activity. The user 10 engages the lower body exercise assembly 120 through the lower body rotary crank assembly 122, by way of the pedals 126 coupled to respective crank arms 124. In a similar manner, the user engages the upper body exercise assembly 170 through the upper body crank assembly 171 by way of the handle members 178. As will be described in following paragraphs, the lower body crank assembly 122 is coupled to a lower body resistance assembly 160, and the upper body crank assembly 171 is coupled to the upper body resistance assembly 210, for independently providing a resistive load force.

The position of the seat 260 with respect to the frame 102 is adjustable, by means of the seat adjusting mechanism 262, the upper body exercise assembly 170 is adjustable to insure that the exercise apparatus 100 is adaptable to the physical characteristics of the user 10 and allows the user to optimally position his body relative to the lower body crank assembly 122. The adjustment of the upper body exercise assembly 171 is made possible by a pair of frame arm members 118, 119, disposed on opposing sides of the frame 102, and positionally located adjacent the center of gravity of the user. Each of the opposing frame arm members 118, 119 is releasably lockingly coupled to the frame 102 by means of a respective adjustment assembly 216. Adjustment assembly may comprise a spring biased pin for engagement with one of a plurality of openings formed in a portion of a respective frame arm member, or any of a variety of clamping devices, well known in the art.

Frame 102 is defined by a longitudinally extended base 103 having a substantially planar contour for supporting exercising apparatus 100 on the base surface 20. A central frame member 104 extends transversely from the planar surface of base 103, in a substantially vertical direction. Central frame member 104 has a substantially inverted U-shaped configuration, wherein opposing ends of central frame member 104 are fixedly coupled to opposing longitudinal ends of base 103. Central frame member 104 may be fixedly coupled to base 103 by means well known in the art.

Central frame member 104 provides a support structure for the lower body exercise assembly 120 and the upper body exercise assembly 170. A housing for substantially enclosing the lower body rotary crank assembly 122, the lower body resistance assembly 160, the upper body crank assembly 171 and the upper body resistance assembly 210 is formed by a pair of frame covers 106, 108 fastened to opposing sides of central frame member 104. Extending from a lower surface of central frame member 104 there is provided a pair of spaced, substantially parallel, mounting plate members 110, 112. The frame 102 further includes a pair of tubular support members 114, 116, each extending from a respective mounting plate 110, 112 transversely from the plane defined by the central frame member 104. Each of the tubular support members 114,116 is supported adjacent its distal end by a respective outrigger frame support member 113,115. Each of the outrigger frame support members 113,115 has an L-shaped contour, and is coupled to a respective tubular support member at its endmost portion of a vertical leg portion, and coupled on the opposing end to the base 103 of frame 102.

Figure 8:
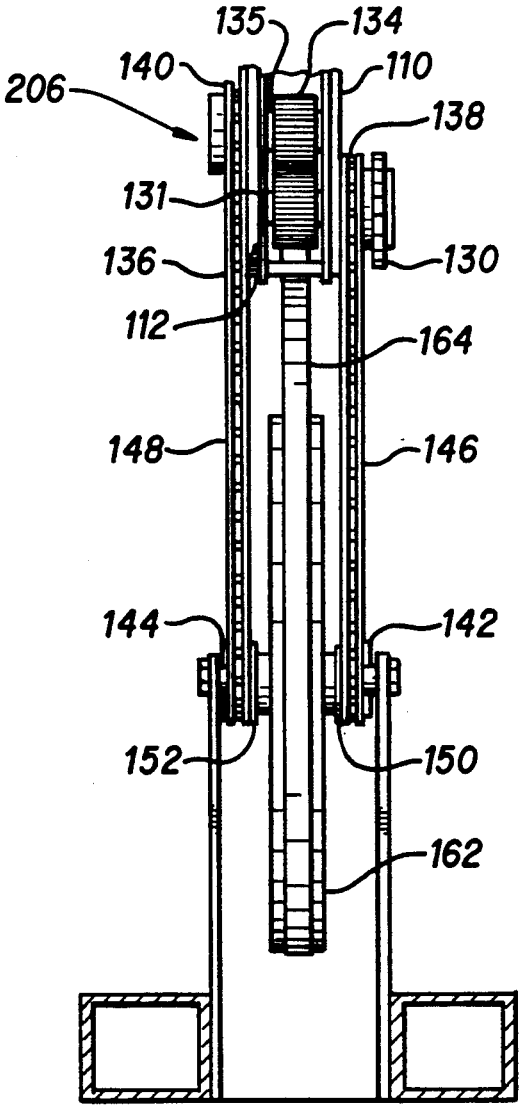

Lower body rotary crank assembly 122, shown in FIGS. 3 and 8, includes a primary driving sprocket wheel 128 rotatively coupled to frame 102. Primary driving sprocket wheel 128 may be rotatively mounted on a bearing supported shaft extending between the frame mounting plates 110,112, opposing ends of the shaft being coupled to respective crank arms 124. Each of the two crank arms 124 is substantially L-shaped, and having a pedal member 126 pivotedly coupled thereto. The crank arm members 124, disposed on opposing sides of the primary driving sprocket wheel 128, are disposed in angular relationship, one to the other, at an angle approximating 180°, as is typically found in bicycle systems.

A primary driven sprocket wheel 130, rotatively coupled to frame 102, is operatively coupled to primary driving sprocket wheel 128 by means of a chain 132, such that driven sprocket wheel 130 rotates responsive to rotation of sprocket wheel 128, and in the same direction therewith. Sprocket wheel 130 is rotatively coupled to frame 102 by means of a bearing supported shaft 131 extending from, and supported between, mounting plates 110 and 112. Sprocket wheel 130 being coupled to shaft 131 for rotation therewith. A secondary driving sprocket wheel 138 is coupled to shaft 131 for rotation coincident with sprocket wheel 130. A secondary driven sprocket wheel 142 is operatively coupled to secondary driving sprocket wheel 138 by means of the chain 146. Thus, secondary driven sprocket wheel 142 rotates responsive to rotation of sprocket wheel 138, and in the same direction therewith. Secondary driven sprocket 142 is coupled to a unidirectional clutch 150 for driving the rotatable member 162 of the lower body resistance assembly 160 in a predetermined direction, the clutch 150 disengaging the sprocket wheel 142 from the rotatable member 162 when such is rotated in an opposite direction.

Lower body crank assembly 122 is designed to drive the rotatable member 162 of lower body resistance assembly 160 in a single predetermined direction, irrespective of the direction the user 10 rotates the crank arms 124. This feature is desired by exercise enthusiasts because it allows a substantially immediate reversal of direction in which the crank arms are rotated, without substantially having to overcome the inertia of the rotatable member 162. While it is desirable that rotatable member 162 be of substantial mass so as to provide a smooth pedaling operation and feel, considerable additional effort would be required to slow down the rotation of member 162 and reverse its direction. Crank assembly 122 overcomes this problem through the use of unidirectional clutches 150 and 152, and a dual chain transmission system 206, to be further described in following paragraphs.

One portion of the dual chain transmission system 206, as described above, includes the secondary driving sprocket wheel 138 which is operatively coupled to the secondary driven sprocket wheel 142, which is in turn coupled to the unidirectional clutch 150, thereby providing the means to rotatively drive the rotatable member 162 in a predetermined direction responsive to rotation of the crank arms 124 in a first direction. A gear 136 is coupled to shaft 131 for rotation coincident with rotation of the secondary driving sprocket 138. Gear 136 is disposed between plate members 110 and 112, such that shaft 131 is rotatively supported by bearings, not shown, disposed within each of mounting plates 110 and 112. Another gear 134, similarly disposed between mounting plates 110 and 112, is meshingly engaged with gear 136, thereby being rotatively driven in a direction opposite to the rotation of gear 136. Gear 134 is coupled to a bearing supported shaft 135, the bearings, not shown, being disposed in respective mounting plates 110 and 112. Shaft 135 extends through mounting plate 112 for coupling to a secondary driving sprocket wheel 140. Sprocket wheel 140 being coupled to a common shaft with gear 134 rotates responsive to, and in a direction coincident with gear 134. A secondary driven sprocket 144 is operatively coupled to sprocket 140 by means of the chain 148, such that sprocket wheel 144 rotates in a direction opposite to that of sprocket wheel 142. Sprocket wheel 144 is coupled to a unidirectional clutch 152 for driving the rotatable member 162 of lower body resistance assembly 160.

Unidirectional clutch 152 provides rotational engagement in a direction opposite to that of clutch 150, which by virtue of the arrangement of clutches 150 and 152 being disposed on opposing sides of rotatable member 162, provides for the engagement of one of clutches 150 or 152 for driving rotatable member 162 in a single predetermined direction. Thus, when crank arm members 124 are rotated in a first direction, the clutch 150 would be engaged, wherein the forces transmitted from the crank arm members 124 would be coupled to the rotatable member 162 by the chains 132 and 146, and sprockets 128, 130, 138 and 142. Alternately, when the crank arms 124 are rotated in a second opposite direction, the forces applied to the crank arms 124 are transmitted to the rotatable member 162 through the clutch 152, by means of the chains 132 and 148 and sprockets 128, 130, 140 and 144. Since the sprocket 142 rotates in a direction opposite to that of 144, the clutch 150 is disengaged when clutch 152 is engaged.

In addition to rotatable member 162, lower body resistance assembly 160 includes a resistance band 164 disposed in frictional engagement with rotatable member 162. The tension of resistance band 164 is adjusted by the independent adjustment mechanism 220, to be described in following paragraphs. Independent adjustment mechanism 220 allows the user to adjust the frictional contact between resistance band 164 and rotatable member 162, providing a resistive load force against which the user exercises. Alternately, other means of establishing a resistive load force may be substituted for the band break type system herein disclosed. Other means of establishing a resistance force such as hydraulic or pneumatic systems wherein a restriction to fluid flow provides the necessary resistance, or electromotive systems may be substituted for the resistance assemblies 160 and 210.

Referring now to FIGS. 1, 2, 3, 5 and 6, upper body exercise assembly 170 is shown to comprise an upper body crank assembly 171 adapted to be adjustable with respect to frame 102 and seat 260 to accommodate varying physical characteristics of users of exercising apparatus 100 and provide optimization of body motion in carrying out the exercise. Upper body crank assembly 171 includes a pair of primary driving sprockets 180, each rotatably mounted in one end of a respective frame arm member 118,119. As will be described in following paragraphs, primary driving sprockets 180 are mechanically coupled one to the other for rotation in unison.

Each of the primary driving sprocket wheels 180 is coupled to a respective shaft 181 which may be bearing supported on opposing sides of a respective frame arm member 118,119. A coupling sleeve member 174 is coupled to each respective shaft 181, and adapted to telescopically receive an adjustable crank arm member 172 therein. Sleeve member 174 is provided with means 175 for releasably lockingly engaging adjustable crank arm member 172. Each of adjustable crank arm members 172 are coupled to a link member 176, at a distal end thereof. Each of link members 176 is pivotedly coupled on one end to a respective adjustable crank arm member 172, and on the opposing end, each is coupled to a handle member 178. Each of link members 176 is provided with a pivotal coupling such that the link member is free to rotate in the same plane of rotation as the respective crank arm member to which it is coupled. However, each of link members 176 includes at least one angular bend such that handle member 178 is disposed obliquely with respect to the plane of rotation of the crank arm members, thereby orientating handle member 178 in a position which has a natural feel to the user.

Disposed within the opposing end of each respective frame arm member 118,119, there is provided a primary driven sprocket wheel 182, each of the two primary driven sprocket wheels 182 being coupled to a common shaft 184 extending therebetween. Each of the primary driven sprocket wheels 182 are operatively coupled to a respective primary driving sprocket wheel 180 by means of a chain 183, such that the driven sprocket wheels 182 rotate responsive to rotation of sprocket wheels 180, and in the same direction therewith. Shaft 184 may be supported by bearings disposed in each of frame arm members 118 and 119, and respective mounting plates 110 and 112. Shaft 184 extends between frame arm members 118 and 119 within the tubular support members 114 and 116, the tubular support members providing a housing therefor.

Figure 5:
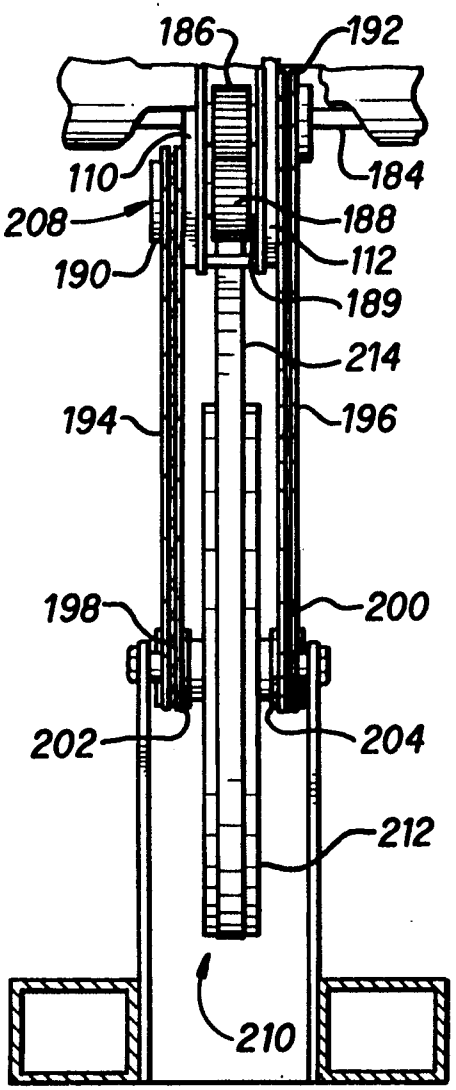
FIG. 5 is a sectional view taken along the section line 5—5 of FIG. 3.

As shown in FIG. 5, a secondary driving sprocket wheel 192 is coupled to shaft 184, adjacent to, and external of, mounting plate 112, for rotation responsive to rotation of primary driven sprocket wheels 182. A secondary driven sprocket wheel 200 is operatively coupled to secondary driving sprocket wheel 192 by means of a chain 196. Secondary driven sprocket wheel 200 is coupled to a unidirectional clutch 204 for driving the rotatable member 212 of the upper body resistance assembly 210 in a predetermined direction, the clutch 204 disengaging the sprocket wheel 200 from the rotatable member 212 when sprocket wheel 200 is rotatably driven in an opposite direction.

Like lower body crank assembly 122, upper body crank assembly 171 includes a dual chain transmission system 208 for driving the rotatable member 212 of upper body resistance assembly 210 in a single predetermined direction, irrespective of the direction the user 10 rotates the crank arms 172. Obviously, this arrangement provides the same advantages as previously discussed for lower body crank assembly 122. In order to accomplish the rotative driving of rotatable member 212, a gear 186 is coupled to shaft 184 for rotation therewith, gear 186 being disposed between mounting plates 110 and 112. A second gear 188 is disposed between mounting plates 110 and 112, and positionally located for meshing engagement with gear 186. Thus, gear 188 is rotatively driven in a direction opposite to the direction of gear 186. Gear 188 is rotatively supported by a shaft 189, which may be supported by bearings, not shown, in each of mounting plates 110 and 112. Shaft 189 extends from mounting plate 110 for coupling with a secondary driving sprocket wheel 190 for rotation coincident therewith. Obviously, since sprocket wheel 190 is rotatively coupled to sprocket wheel 192 through gears 186 and 188, sprocket wheel 190 rotates in a direction opposite to that of sprocket wheel 192. A secondary driven sprocket wheel 198 is operatively coupled to sprocket wheel 190 by means of the chain 194, and thus rotates in a direction opposite to secondary driven sprocket wheel 200. Secondary driven sprocket wheel 198 is coupled to a unidirectional clutch 202 for rotatively driving the rotatable member 212 of upper body resistance assembly 210 in the same direction as unidirectional clutch 204.

Unidirectional clutch 202 provides rotational engagement in a direction opposite to that of clutch 204, which by virtue of the arrangement of clutches 202 and 204 being disposed on opposing sides of rotatable member 212, provides for the engagement of one of clutches 202 or 204 for driving rotatable member 212 in a single predetermined direction. Thus, when crank arm members 172 are rotated in a first direction, the clutch 204 would be engaged, wherein the forces transmitted from the crank arms members 172 to the shaft 184 would be coupled to rotatable member 212 by the chain 196 which rotatively couples the sprockets 192 and 200. When the crank arms 172 are rotated in a second opposite direction, the forces applied thereto are transmitted to the rotatable member 212 through clutch 202, by the chain 194 which couples sprockets 198 and 190. Since sprocket 190 rotates in a direction opposite to that of sprocket 192, by virtue of their being coupled through the gears 186 and 188, the rotatable member 212 is driven in the same direction as when the crank arm members were rotated oppositely. When clutch 202 is engaged, the clutch 204 is disengaged.

In addition to rotatable member 212, upper body resistance assembly 210 includes a resistance band 214 disposed in frictional engagement with rotatable member 212. The tension of resistance band 214 is adjusted by the independent adjustment mechanism 220, to be described in following paragraphs. Independent adjustment mechanism 220 provides the means for adjusting the frictional contact between resistance band 214 and rotatable member 212, providing the resistive load force against which the user exercises. As in the lower body resistance assembly 160, other means of establishing a resistive load force may be substituted for the band break type system herein disclosed.

Figure 4:
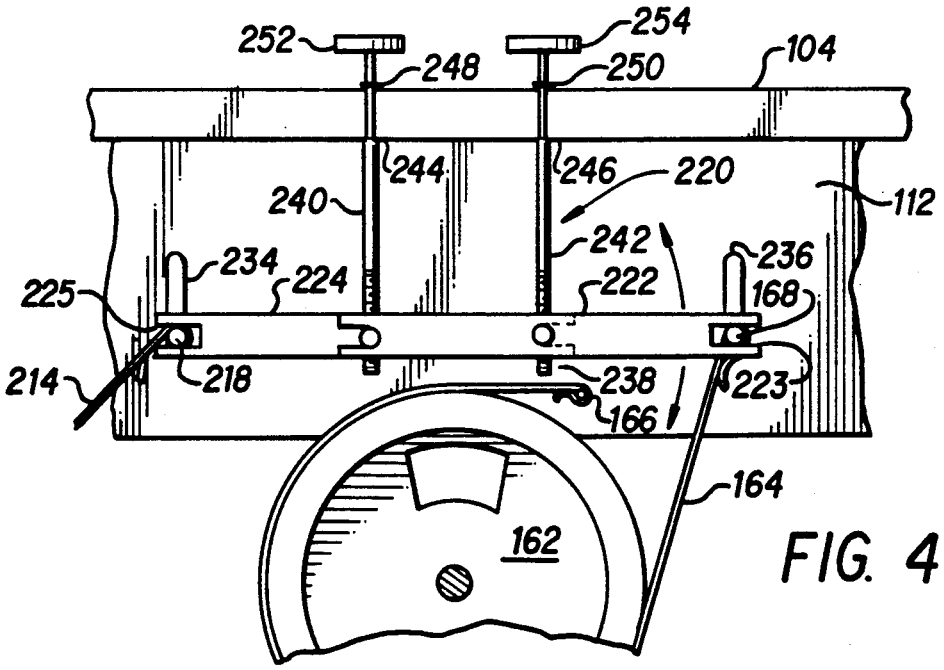
FIG. 4 is a sectional view, partially in cutaway, of the independent adjustment mechanism.
Figure 6:
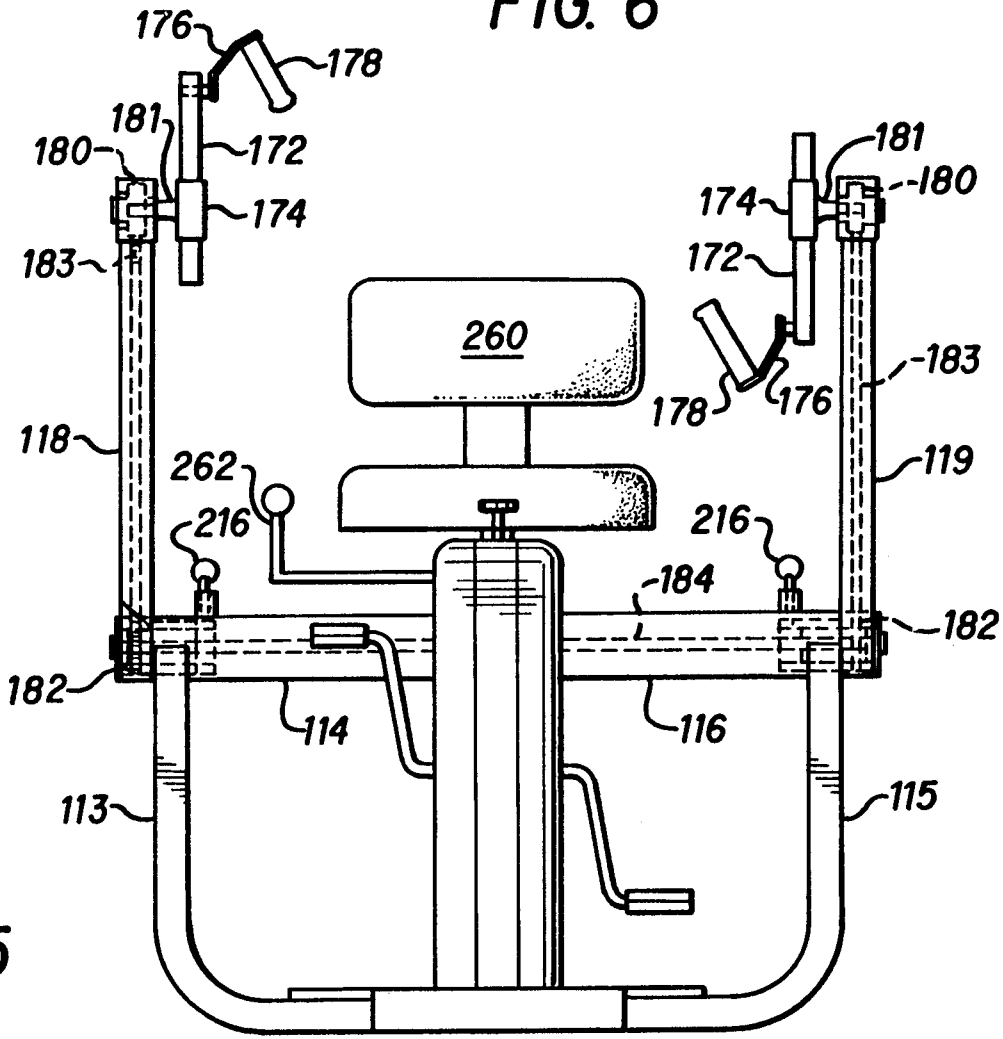
FIG. 6 is a frontal view of the exercise apparatus.
Figure 7:
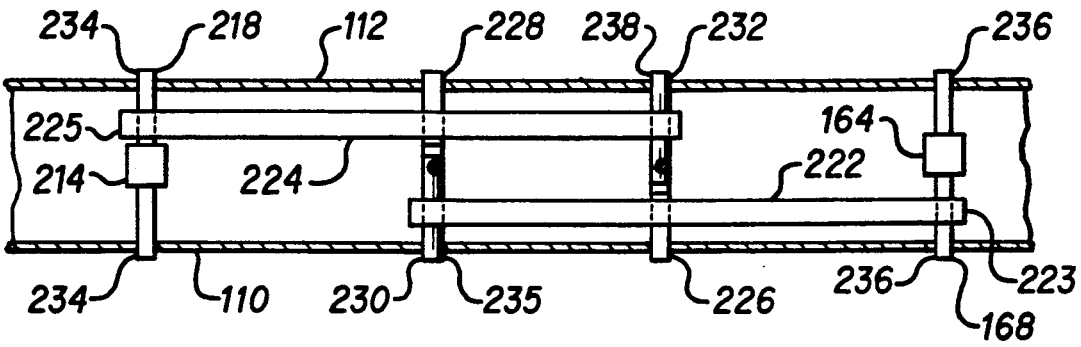
FIG. 7 is a top sectional view, partially in cutaway, of the independent adjustment mechanism shown in FIG. 4; and, FIG. 8 is a sectional view taken along the section line 8—8 of FIG. 3.

Referring now to FIGS. 4 and 7, there is shown, independent adjustment mechanism 220 which provides the ability to independently adjust the tension of the respective resistance bands 164 and 214, thereby establishing the resistive force on the respective rotatable members 162 and 212. As exemplified by the arrangement for the lower body resistance assembly 160, one end of the resistance band 164 is coupled to a location positioned between the mounting plates 110 and 112 by a fastener 166. The band 164 is wrapped about the rotatable member 162 and is secured to a lever member 222 by means of a pin 168 disposed within a slotted opening formed in the bifurcated end 223 of lever 222. Lever 222 is pivotedly coupled to mounting plate 110 by means of a pivot pin 226. The opposing end of lever member 222 is pivotedly coupled to a threaded coupling 230, extending transverse the longitudinal axis of lever 222.

Threaded coupling 230 is threadedly engaged to a threaded shaft 240, on one end, and extends through a slotted through opening 235 formed in the mounting plate 110. Threaded shaft 240 is rotatively coupled to central frame member 104, and prevented from being axially displaced by means of a shoulder 244 formed on shaft 240 for engagement with a lower surface of frame member 104, and an E-ring type fastener 248 coupled to shaft 240 adjacent the upper surface of frame member 104. A knob 252 coupled to the end of threaded shaft 240 allows the user to rotate the shaft, which results in the displacement of the threaded coupling 230. Displacement of threaded coupling 230 in turn results in pivoting of the lever member 222 to increase, or decrease, the tension in resistance band 164, responsive to the direction of rotation of knob 252. Pin 168 extends between mounting plates 110 and 112, extending through opposed slotted openings 236, formed in each of the respective mounting plates, with the resistance band 164 being coupled to pin 168 therebetween.

Independent adjustment mechanism 220 further includes a lever member 224 coupled to the resistance band 214 in a manner similar to that just described for resistance band 164. Lever 224 is pivotedly coupled to the mounting plate 112 by means of the pivot pin 228. The resistance band 214 is coupled to pin 218 intermediate opposing ends thereof, the opposing ends of pin 218 extending between the slotted openings 234 formed in respective mounting plates 110 and 112. Pin 218 is captured within the slotted opening formed in the bifurcated end 225 of lever member 224 for displacement therewith. Coupled to the opposing end of lever member 224 there is provided a threaded coupling 232, extending transverse the longitudinal axis of lever member 224.

Threaded coupling 232 is threadedly coupled to a threaded shaft 242 on one end, and on the opposing end extends through a slotted opening 238 formed in the mounting plate 112. Threaded shaft 242 is provided with a knob 254 on one end, and is threaded on the opposing end to engage the threaded coupling 232. Threaded shaft 242 is rotatively coupled to central frame member 104 through an opening formed therein, and includes a shoulder 246 for preventing upward displacement of shaft 242 through the opening formed in central frame member 104. Adjacent the upper surface of central frame member 104 threaded shaft 242 is adapted for receiving an E-ring type fastener 250, for preventing the downward displacement of threaded shaft 242. Thus, when knob 254 is rotated, such results in displacement of threaded coupling 232, which in turn displaces the bifurcated end 225 of lever member 224, thereby tightening or loosening the tension of resistance band 214, dependent upon the direction knob 254 is rotated.

As shown in FIGS. 1, 2, 3 and 6, total body exercising apparatus 100 is adapated to accommodate users of a wide range of physical characteristics. A seat 260 is slidingly coupled to frame 102 to be adjustably positioned relative to the foot pedals 126. Seat 260 may be releasably lockingly secured to central frame member 104, and mounting plates 110 and 112 by means of a seat adjustment mechanism 262. Seat adjustment mechanism 262 may be any one of a plurality of standard adjustment mechanisms well known in the art. Subsequent to adjustment of the seat relative to the foot pedals, the user may then adjust the angular position of the frame arm members 118 and 119, and the position of the handles 178 relative to the rotatively coupled crank arm sleeve members 174, by extending the adjustable crank arm members therefrom. The position of crank arm members 172 is releasably lockingly coupled to sleeve members 174 by the respective pin members 175 which engage one of a plurality of through openings formed in a respective crank arm member 172.

This dual adjustment, the angle of the frame arm members, and the length of the crank arms provides both comfort to the user and allows versatility in the muscle groups which are exercised. When the frame arm members are positioned close to the user's shoulders the exercise is directed to predominantly the arm muscles. Whereas, when the frame arm members are angled away from the user's shoulders, the exercising adds shoulder and back muscle groups to the arm muscles being exercised. By pivoting the frame arm members from a location in the neighborhood of a plane passing through the center of gravity of the user, the advantages of the dual adjustability of exercising apparatus 100 is made available to users having a wide range of physical characteristics. In this way, all users can independently position the crank assembly relative to their shoulders, and adjust the length of the stroke they wish to utilize. Thus, the exercise effect can be optimized for each individual.

Hence, it can be seen that total body exercising apparatus provides a unique system wherein both the upper and lower body can be exercised, separately, or in combination. The system uniquely providing, in an esthetic, compact package, separate and independent resistance force assemblies 160 and 210, which are individually adjustable, allowing the user to tailor the effort of his upper separate from his lower body to suit his individual needs and abilities.

Although this invention has been described in conjunction with specific forms and embodiments thereof, it will be appreciated that various modifications other than those discussed above may be restored to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended Claims.

What is claimed is:

1. A total body exercising apparatus, comprising:

a. a frame including a central frame member having an inverted substantially U-shaped contour, said frame further including (1) a pair of tubular support members coupled to said central frame member, each of said pair of tubular support members extending transversely from opposing sides of said central frame member, and (2) a pair of opposing frame arm members, each of said pair of frame arm members being coupled in a predetermined angular position to a respective one of said pair of tubular support members;

b. means for exercising a lower body portion of a user coupled to said frame, said lower body exercise means including (1) first rotary crank means for rotation in either of two opposite directions, and (2) first resistance means coupled to said first rotary crank means for providing a selectively adjustable force resistive to rotation of said first rotary crank means; and, c. means for exercising an upper body portion of said user coupled to said frame, said upper body exercise means including (1) second rotary crank means for rotation in either of two opposite directions, and (2) second resistance means coupled to said second rotary crank means for providing a selectively adjustable force resistive to rotation of said second rotary crank means.

2. The total body exercising apparatus as recited in claim 1 where said second rotary crank means includes a pair of adjustable crank arm members, each of said pair of adjustable crank arm members having a selectively adjustable length dimension.

3. The total body exercising apparatus as recited in claim 2 where said second rotary crank means further includes (1) a pair of link members, each one of said pair of link members being pivotally coupled to a respective one of said pair of adjustable crank arm members for rotation in a plane substantially parallel to a plane of rotation defined by said second rotary crank means, and (2) a pair of handgrip members, each of said handgrip members being pivotally coupled to a respective one of said pair of link members, each of said handgrip members being disposed obliquely with respect to said plane of rotation of said second rotary crank means.

4. The total body exercising apparatus as recited in claim 1 where said frame further includes a housing defined by a pair of cover members coupled to opposing sides of said central frame member, said housing enclosing both said first and second resistance means.

5. The total body exercising apparatus as recited in claim 1 further comprising means for independently adjusting resistive forces applied by said first resistance means and said second resistance means, said resistance force adjusting means being coupled to said frame.

6. The total body exercising apparatus as recited in claim 5 where said resistive force adjusting means includes a pair of lever members.

7. The total body exercising apparatus as recited in claim 6 where each of said a pair of lever members is pivotally coupled to said frame for displacement of a first end responsive to displacement of an opposing second end.

8. The total body exercising apparatus as recited in claim 7 where said first end of each of said a pair of lever members is coupled to a respective resistance member, said second end of each of said pair of lever members being threadedly coupled to a respective rotatable shaft member for displacement of said second end responsive to rotation of said shaft member.

9. The total body exercising apparatus as recited in claim 1 where said first rotary crank means includes:

a first sprocket wheel rotatively coupled to said frame;

a pair of crank arm members, each one of said pair of crank arm members being coupled to an opposing side of said first sprocket wheel for rotatively driving said first sprocket wheel in either of two opposite directions responsive to displacement of said user's lower body portions;

a second sprocket wheel operatively coupled to said first sprocket member for rotation coincident therewith;

a first gear rotatively coupled to said second sprocket wheel for rotation therewith;

a second gear meshingly engaged to said first gear member for rotation in a direction opposite a rotational direction of said first gear;

a pair of third sprocket wheels, one of said pair of third sprocket wheels being rotatively coupled to said first gear for rotation in said first direction, the other of said pair of third sprocket wheels being rotatively coupled to said second gear for rotation in said second direction;

a pair of fourth sprocket wheels, each of said fourth sprocket wheels being operatively coupled to a respective one of said third sprocket wheels for responsive rotation therewith;

a first unidirectional clutch having an input portion coupled to a respective one of said pair of fourth sprocket wheels and an output portion coupled to said first resistance means, said first unidirectional clutch drivingly coupling said first resistance means responsive to said rotation of said first sprocket wheel in a first direction; and, a second unidirectional clutch having an input portion coupled to a respective other of said pair of fourth sprocket wheels and an output portion coupled to said first resistance means, said second unidirectional clutch drivingly coupling said first resistance means responsive to said rotation of said first sprocket wheel in a second direction, whereby said first resistance means is rotatively driven in a single direction irrespective of said direction of said first sprocket wheel rotation.

10. The total body exercising apparatus as recited in claim 9 where said first rotary crank means further includes a pair of foot pedal members, each of said foot pedal members being pivotally coupled to a respective one of said crank arm members.

11. The total body exercising apparatus as recited in claim 1 where said second rotary crank means includes:

a pair of first sprocket wheels, each of said pair of first sprocket wheels being rotatively coupled to a respective one of said frame arm members;

a pair of crank arm members, each one of said pair of crank arm members being coupled to a respective one of said pair first sprocket wheels for rotatively driving said pair of first sprocket wheels in either of two opposite directions responsive to displacement of said user's upper body portions;

a pair of second sprocket wheels operatively coupled to said pair of first sprocket wheels for rotation coincident therewith, said pair of second sprocket wheels being coupled one to the other;

a first gear rotatively coupled to said pair of second sprocket wheels for rotation therewith;

a second gear meshingly engaged to said first gear member for rotation in a direction opposite a rotational direction of said first gear;

a pair of third sprocket wheels, one of said pair of third sprocket wheels being rotatively coupled to said first gear for rotation in said first direction, the other of said pair of third sprocket wheels being rotatively coupled to said second gear for rotation in said second direction;

a pair of fourth sprocket wheels, each of said fourth sprocket wheels being operatively coupled to a respective one of said third sprocket wheels for responsive rotation therewith;

a first unidirectional clutch having an input portion coupled to a respective one of said pair of fourth sprocket wheels and an output portion coupled to said second resistance means, said first unidirectional clutch drivingly coupling said second resistance means responsive to said rotation of said pair of first sprocket wheels in a first direction; and, a second unidirectional clutch having an input portion coupled to a respective other of said pair of fourth sprocket wheels and an output portion coupled to said second resistance means, said second unidirectional clutch drivingly coupling said second resistance means responsive said rotation of said pair of first sprocket wheels in a second direction, whereby said second resistance means is rotatively driven in a single direction irrespective of said direction of rotation of said pair of first sprocket wheels.

12. The total body exercising apparatus, comprising:

a. a frame;

b. first rotary crank means pivotally coupled to said frame for rotation in either of two opposite directions;

c. first resistance means coupled to said first rotary crank means for providing a selectively adjustable force resistive to rotation of said first rotary crank means, said first resistance means including a first rotatable member driven by said first rotary crank means in a predetermined direction irrespective of said rotative direction of said first rotary crank means;

d. second rotary crank means coupled to said frame for rotation in either of two opposite directions, said second rotary crank means including (1) a pair of tubular support members coupled to said frame, each of said pair of tubular support members extending transversely from opposing sides of said frame, and (2) a pair of opposing frame arm members, each of said pair of frame arm members being releasably lockingly coupled in any one of a plurality of predetermined angular positions to a respective one of said pair of tubular support members for providing adjustable positioning of said second rotary crank means; and, e. second resistance means coupled to said second rotary crank means for providing a selectively adjustable force resistive to rotation of said second rotary crank means, said second resistance means including a second rotatable member driven by said second rotary crank means in a predetermined direction irrespective of said rotative direction of said second rotary crank means.

13. The total body exercising apparatus as recited in claim 12 further comprising means for independently adjusting resistive forces applied by said first rotatable member and said second rotatable member, said resistance force adjusting means being coupled to said frame.

14. The total body exercising apparatus as recited in claim 13 where said resistive force adjusting means includes a pair of lever members.

15. The total body exercising apparatus as recited in claim 14 where each of said a pair of lever members is pivotally coupled to said frame for displacement of a first end responsive to displacement of an opposing second end.

16. The total body exercising apparatus as recited in claim 15 where said first end of each of said a pair of lever members is coupled to a respective resistance member for adjusting a frictional engagement between said resistance member and a respective one of said first and second rotatable members, said second end of each of said pair of lever members being threadedly coupled to a respective rotatable shaft member for displacement of said second end responsive to rotation of said shaft member.

17. The total body exercising apparatus as recited in claim 12 where said first rotary crank means includes:

a first sprocket wheel rotatively coupled to said frame;

a pair of crank arm members, each one of said pair of crank arm members being coupled to an opposing side of said first sprocket wheel for rotatively driving said first sprocket wheel in either of two opposite directions responsive to displacement of said user's lower body portions;

a second sprocket wheel operatively coupled to said first sprocket member for rotation coincident therewith;

a first gear rotatively coupled to said second sprocket wheel for rotation therewith;

a second gear meshingly engaged to said first gear member for rotation in a direction opposite a rotational direction of said first gear;

a pair of third sprocket wheels, one of said pair of third sprocket wheels being rotatively coupled to said first gear for rotation in said first direction, the other of said pair of third sprocket wheels being rotatively coupled to said second gear for rotation in said second direction;

a pair of fourth sprocket wheels, each of said fourth sprocket wheels being operatively coupled to a respective one of said third sprocket wheels for responsive rotation therewith;

a first unidirectional clutch having an input portion coupled to a respective one of said pair of fourth sprocket wheels and an output portion coupled to said first rotative member, said first unidirectional clutch drivingly coupling said first rotative member responsive to said rotation of said first sprocket wheel in a first direction; and, a second unidirectional clutch having an input portion coupled to a respective other of said pair of fourth sprocket wheels and an output portion coupled to said first rotative member, said second unidirectional clutch drivingly coupling said first rotative member responsive to said rotation of said first sprocket wheel in a second direction, whereby said first rotative member is rotatively driven in a single direction irrespective of said direction of said first sprocket wheel rotation.

18. The total body exercising apparatus as recited in claim 12 where said second rotary crank means further includes:

a pair of first sprocket wheels, each of said pair of first sprocket wheels being rotatively coupled to a respective one of said frame arm members;

a pair of crank arm members, each one of said pair of crank arm members being coupled to a respective one of said pair first sprocket wheels for rotatively driving said pair of first sprocket wheels in either of two opposite directions responsive to displacement of said user's upper body portions;

a pair of second sprocket wheels operatively coupled to said pair of first sprocket wheels for rotation coincident therewith, said pair of second sprocket wheels being coupled one to the other;

a first gear rotatively coupled to said pair of second sprocket wheels for rotation therewith;

a second gear meshingly engaged to said first gear member for rotation in a direction opposite a rotational direction of said first gear;

a pair of third sprocket wheels, one of said pair of third sprocket wheels being rotatively coupled to said first gear for rotation in said first direction, the other of said pair of third sprocket wheels being rotatively coupled to said second gear for rotation in said second direction;

a pair of fourth sprocket wheels, each of said fourth sprocket wheels being operatively coupled to a respective one of said third sprocket wheels for responsive rotation therewith;

a first unidirectional clutch having an input portion coupled to a respective one of said pair of fourth sprocket wheels and an output portion coupled to said second rotative member, said first unidirectional clutch drivingly coupling said second rotative member responsive to said rotation of said pair of first sprocket wheels in a first direction; and, a second unidirectional clutch having an input portion coupled to a respective other of said pair of fourth sprocket wheels and an output portion coupled to said second rotative member, said second unidirectional clutch drivingly coupling said second rotative member responsive said rotation of said pair of first sprocket wheels in a second direction, whereby said second rotative member is rotatively driven in a single direction irrespective of said direction of rotation of said pair of first sprocket wheels.

* * * * *